US011530540B2

(12) United States Patent
Downey et al.

(10) Patent No.: US 11,530,540 B2
(45) Date of Patent: Dec. 20, 2022

(54) SOUND TRANSMISSION CONTROL IN CROSS LAMINATED TIMBER CONSTRUCTION

(71) Applicant: Pliteq Inc., Toronto (CA)

(72) Inventors: Paul Charles Downey, Toronto (CA); Wilson Byrick, Toronto (CA)

(73) Assignee: Pliteq Inc., Toronto (CA)

( * ) Notice: Subject to any disclaimer, the term of this patent is extended or adjusted under 35 U.S.C. 154(b) by 0 days.

(21) Appl. No.: 17/318,571

(22) Filed: May 12, 2021

(65) Prior Publication Data

US 2022/0364373 A1 Nov. 17, 2022

(51) Int. Cl.

| | |
|---|---|
| ***E04F 15/22*** | (2006.01) |
| ***E04F 15/20*** | (2006.01) |
| ***E04F 15/08*** | (2006.01) |
| *E04B 1/82* | (2006.01) |

(52) U.S. Cl.

CPC ..... *E04F 15/203* (2013.01); *E04F 15/082* (2013.01); *E04F 15/225* (2013.01); *E04B 2001/8254* (2013.01)

(58) Field of Classification Search

CPC ..... E04F 15/02447; E04F 15/02452; E04F 15/02458; E04F 15/041; E04F 15/045; E04F 15/042; E04F 15/043; E04F 15/18; E04F 15/20; E04F 15/203; E04F 15/206; E04F 15/22; E04F 15/225; E04F 15/204; E04F 15/082; E04F 2290/04; E04F 2290/041; E04F 2290/042; E04F 2290/043; E04B 1/8209; E04B 1/26; E04B 2001/8263; E04B 2001/8254; E04B 5/12; E04B 5/28; E04B 9/001; E04B 9/045; E04B 9/04; E04B 9/0457; E04B 2009/186

See application file for complete search history.

(56) References Cited

U.S. PATENT DOCUMENTS

| | | | | | |
|---|---|---|---|---|---|
| 2,115,238 | A * | 4/1938 | Stevens | E04F 15/225 | 52/480 |
| 4,110,948 | A * | 9/1978 | Maier, Jr. | E04D 3/3608 | 52/489.1 |
| 4,589,243 | A * | 5/1986 | Abendroth | E04B 1/0007 | 52/480 |
| 5,111,627 | A * | 5/1992 | Brown | E04F 15/08 | 52/126.5 |
| 5,277,010 | A * | 1/1994 | Stephenson | E04F 15/225 | 52/480 |

(Continued)

FOREIGN PATENT DOCUMENTS

| | | | | |
|---|---|---|---|---|
| EP | 2048298 A2 * | 4/2009 | | E04B 5/12 |
| JP | 2020133283 A * | 8/2020 | | |
| WO | WO-2020101751 A1 * | 5/2020 | | B32B 13/045 |

*Primary Examiner* — Kyle J. Walraed-Sullivan
(74) *Attorney, Agent, or Firm* — Rowand LLP

(57) ABSTRACT

A method of reducing sound transmission in a building constructed using horizontal cross laminated timber (CLT) panels to provide a floor of the building and a floor assembly are described. In an implementation, the method includes: attaching a plurality of energy transmission control mounts to a ceiling side of one or more of the cross-laminated timber panels using fasteners; attaching a plurality of furring channels to the energy transmission control mounts; and attaching a cross laminated timber sheet to the plurality of furring channels to form an exposed ceiling layer.

34 Claims, 7 Drawing Sheets

(56) References Cited

U.S. PATENT DOCUMENTS 5,412,917 A * 5/1995 Shelton ..... E04F 15/22 52/480
5,497,590 A * 3/1996 Counihan ..... E04F 15/22 52/480
5,778,621 A * 7/1998 Randjelovic ..... E04F 15/22 52/480
5,906,082 A * 5/1999 Counihan ..... E04F 15/203 52/480
6,122,873 A * 9/2000 Randjelovic ..... E04F 15/22 52/480
6,164,031 A * 12/2000 Counihan ..... E04F 15/02 52/489.1
6,367,217 B1 * 4/2002 Niese ..... E04F 15/225 52/480
8,307,597 B2 * 11/2012 Tucker, Jr. ..... E04F 15/041 52/480
8,955,279 B1 * 2/2015 Clairmont ..... E04F 15/22 52/480
11,060,579 B2 7/2021 Downey et al.
11,280,096 B1 * 3/2022 Bussey ..... E04F 15/187
2002/0178675 A1 * 12/2002 Valentine ..... E04F 15/225 52/480
2002/0189184 A1 * 12/2002 Shelton ..... E04F 15/225 52/480
2003/0033779 A1 * 2/2003 Downey ..... A63C 19/04 472/92
2004/0245427 A1 * 12/2004 Meisel ..... F16F 1/44 248/562
2007/0000198 A1 * 1/2007 Payne, Jr. ..... E04B 5/40 52/414
2008/0017780 A1 * 1/2008 Downey ..... F16F 1/373 248/610
2008/0086966 A1 * 4/2008 Stevens ..... F16F 1/3732 52/347
2010/0205885 A1 * 8/2010 Randjelovic ..... E04F 15/02 52/403.1
2010/0326011 A1 * 12/2010 Norling ..... E04C 2/24 52/796.1
2013/0008741 A1 * 1/2013 Kim ..... E04F 15/225 181/290
2013/0104479 A1 * 5/2013 Thornton ..... E04F 15/225 52/309.4
2014/0283468 A1 * 9/2014 Weitzer ..... E04F 13/10 52/390
2015/0040504 A1 * 2/2015 Mei ..... E04B 1/2608 52/741.1
2016/0258155 A1 * 9/2016 Zollig ..... E04B 9/12
2017/0114552 A1 * 4/2017 Randjelovic ..... E04B 5/43
2019/0218795 A1 * 7/2019 Blomgren ..... E04F 15/046
2019/0249425 A1 * 8/2019 Tschiersch ..... E04B 1/948
2020/0149288 A1 * 5/2020 Griechen ..... E04B 1/08
2020/0215784 A1 * 7/2020 Kuhn ..... B32B 21/10
2020/0386000 A1 * 12/2020 Randjelovic ..... E04F 15/225
2021/0062520 A1 * 3/2021 Beyreuther ..... E04F 15/02044
2021/0108087 A1 * 4/2021 Herbon ..... C09D 1/02
2021/0115682 A1 * 4/2021 Randjelovic ..... E04F 15/22
2021/0295813 A1 * 9/2021 Gernhart ..... E04B 1/82
2021/0396006 A1 * 12/2021 Collins ..... E04B 1/625
2021/0396025 A1 * 12/2021 Smith ..... B32B 25/042
2022/0081915 A1 * 3/2022 Igo ..... E04F 15/02155

* cited by examiner

1000

SOUND TRANSMISSION CONTROL IN CROSS LAMINATED TIMBER CONSTRUCTION

TECHNICAL FIELD

The present application relates to acoustic insulation and, more particularly, to methods, floor assemblies and buildings that reduce the transmission of sound in cross laminated timber construction.

BACKGROUND

Cross laminated timer (CLT) construction is relatively new method of construction which uses multi-layer timber products that span two directions. CLT provides a number of benefits over concrete construction. For example, CLT construction may be significantly lighter than concrete and may be have a reduced carbon footprint than concrete construction. CLT also allows for prefabrication of floor and wall panels before they reach the construction site, which may reduce construction costs.

One challenge with CLT construction, however, is sound transmission. It can be difficult to achieve acceptable acoustic performance with CLT construction. The sound transmission properties of CLT present difficulties for use in multi-family construction, where it is important to reduce sound transmission between floors. Building codes often specify minimum sound transmission requirements for multi-family buildings and such requirements can be difficult to satisfy when CLT construction is used.

DESCRIPTION OF THE DRAWINGS

Embodiments are described in detail below, with reference to the following drawings.

Like reference numerals are used in the drawings to denote like elements and features.

DETAILED DESCRIPTION OF VARIOUS EMBODIMENTS

In an aspect, a method of reducing sound transmission in a building constructed using horizontal cross laminated timber (CLT) panels to provide a floor of the building is described. The method may include: attaching a plurality of energy transmission control mounts to a ceiling side of one or more of the cross-laminated timber panels using fasteners; attaching a plurality of furring channels to the energy transmission control mounts; and attaching a cross laminated timber sheet to the plurality of furring channels to form an exposed ceiling layer.

In another aspect, a floor assembly in a building is described. The floor assembly may include a cross laminated timber (CLT) panel. The floor assembly may also include a plurality of energy transmission control mounts attached to a ceiling side of the cross-laminated timber panel using fasteners and a plurality of furring channels attached to the energy transmission control mounts. The floor assembly may also include a cross laminated timber sheet attached to the plurality of furring channels to form an exposed ceiling layer.

Conveniently, in this way, a CLT floor assembly may be constructed to have sound reduction properties but the floor assembly may appear, from the ceiling below, as though it is a solid CLT panel. That is, a CLT layer may be exposed on the lowest side of the CLT floor assembly. This may obviate any need to install gypsum or another ceiling treatment. The exposed CLT layer may be left unfinished or it may simply have a liquid surface treatment, such as paint, varnish, or stain applied thereon.

Further conveniently, in at least some implementations, since no layers of the structural CLT panel are exposed (i.e., visible after construction is complete), the structural CLT panels which are quite heavy and difficult to handle need not have sides that have been prepared as a finished layer. In some implementations the sides of the structural CLT panels may be left rough finished. Any imperfections on the CLT panels may not affect aesthetics of the floor assembly.

Other aspects and features of the present application will be understood by those of ordinary skill in the art from a review of the following description of examples in conjunction with the accompanying figures.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

Figure 1:
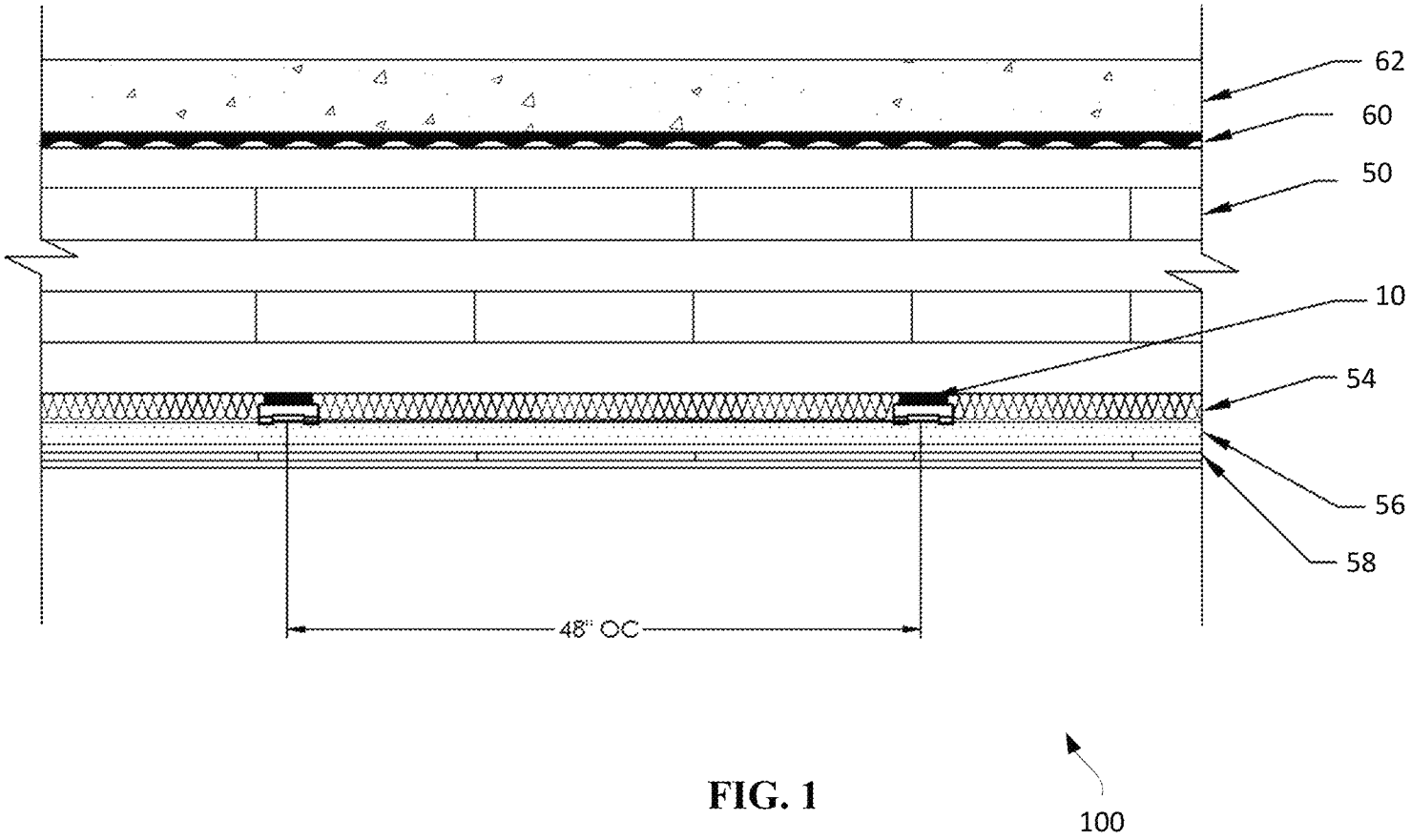
FIG. 1 is a cross section of a floor assembly of an example embodiment.

Reference will first be made to FIG. 1, which is a cross section of an example floor assembly 100. The example floor assembly includes a cross laminated timber (CLT) panel 50. The CLT panel 50 may also be referred to as a CLT layer. The CLT panel 50 is an engineered wood panel. The CLT panel 50 may be constructed of lumber boards stacked in alternating directions. The boards may be bonded together with a high-grade structural adhesive. The boards may be pressed together to form a solid panel. The panel may be provided in a rectangular form and installed in a building or other structure. For example, a number of CLT panels 50 may be installed as a floor of a building or as a wall. In the example of FIG. 1, the CLT panel 50 is included in a floor assembly 100.

The CLT panel 50 may be of varying thicknesses and may have a variable number of layers. The number of layers will depend on building structural requirements. In the example illustrated, the CLT panel 50 has five layers, though CLT panels sometimes have three, five, seven or nine layers. It is also possible to have a different number of layers, including an even number of layers. The panel thickness will also depend on building structural requirements. CLT panels 50 may, for example, be available in thicknesses that are four inches or more. For example, CLT panels 50 usually range between about 4 to 12 inches in thickness, but these panels can sometimes be larger.

The CLT panel 50 has a top side, which may be referred to as a floor side, and a bottom side which may be referred to as a ceiling side. The floor side is a side that defines a floor for a space above the floor assembly 100 and the CLT panel 50 while the ceiling side represents a side that is associated with a ceiling for a floor below the floor assembly 100 and the CLT panel 50.

The floor assembly 100 includes a plurality of energy transmission control mounts 10 attached to the CLT panel. The energy transmission control mounts 10 are attached to the CLT panel. The energy transmission control mounts 10 may be attached to the ceiling side of the CLT panel using fasteners. The fasteners may, in at least some implementations be screws.

The energy transmission control mounts 10 may also be referred to as sound isolation clips. Example energy transmission control mounts 10 will be described in greater detail below, for example, with reference to FIGS. 2 to 4. In at least some implementations, the energy transmission control mounts 10 may be of a type described in U.S. Pat. No. 7,895,803, the contents of which are incorporated herein by reference.

The energy transmission control mounts 10 may be installed row-wise. That is, a set of energy transmission control mounts 10 are installed in a straight line, which defines a first row, and another set of energy transmission control mounts 10 are installed in another straight line, which defines a second row, which is parallel to the first row. Another set of energy transmission control mounts 10 may be installed in another straight line to define a third row, parallel to both the first and second rows. The rows may be separated by a consistent spacing. Within a given row, the energy transmission control mounts 10 may be installed with a consistent spacing. For example, in the example of FIG. 1, the energy transmission control mounts 10 are installed at a spacing interval of 48" off center. The spacing may vary.

The energy transmission control mounts 10 may be configured to decouple a lower CLT sheet 58 from the structural CLT panel 50. Such decoupling may be used for vibration control of structure-borne noise.

The floor assembly 100 may also include insulation 54. The insulation may be, for example, R8 insulation. The insulation 54 may be of various types. For example, in some implementations, the insulation 54 may be fiberglass insulation. In other implementations, the insulation 54 may be mineral wool insulation. In other implementations, the insulation 54 may be rigid foam insulation. The insulation 54 aids in reducing sound transmission through the floor assembly 100.

The insulation 54 is installed within a gap or cavity below the CLT panel 50. In the example of FIG. 1, the gap or cavity is defined using a plurality of furring channels 56. The furring channels are attached to the energy transmission control mounts. For example, the furring channels may be inserted within channels 20 (FIG. 3) defined by the energy transmission control mounts. An example of how a furring channel 56 may be attached to the energy transmission control mounts is illustrated in FIG. 4 and will be discussed in greater detail below.

The furring channels 56 are installed row-wise. For example, the rows defined by the energy transmission control mounts 10 may be used to install the furring channels 56 in rows. One furring channel 56 may be installed parallel to one or more others of the furring channels.

In this way, the furring channels are attached to define a gap below the CLT panels and, as noted above, insulation 54 may be inserted within this gap. In the illustrated example, the gap corresponds to the height of the energy transmission control mounts 10. In the illustrated example, the insulation 54 fills this gap.

In the illustrated example, another gap may be provided in the spacing between adjacent furring channels. In the illustrated example, this gap is empty but in other implementations this gap or cavity may include insulation. Such insulation may be included instead of or in addition to the insulation 54 included in the gap defined between the CLT panel 50 and the furring channels 56.

The furring channels 56 may, in at least some implementations, be hat channels. These hat channels may be received in the channels of the energy transmission control mounts. No fastener (such as a screw) is used to connect the furring channels 56 to the energy transmission control mounts 10 such that the furring channels 56 are decoupled to the energy transmission control mounts 10.

As illustrated in FIG. 1, a CLT sheet 58 is attached to the furring channels. This CLT sheet 58 forms an exposed ceiling layer. That is, the CLT sheet 58 is installed such that an underside of the CLT sheet 58 is exposed and may be seen by an occupant of the floor below.

The CLT sheet 58 may, in some implementations, be three quarter inches or less in thickness. In some implementations, the CLT sheet 58 may be one inch or less in thickness.

The CLT sheet 58 is thinner than the CLT panel 50, which forms the structure of the floor. The CLT sheet 58 may have layers that are thinner than the layers of the structural CLT panel 50. For example, the CLT sheet 58 may have layers that are each less than one third of the thickness of the layers of the cross laminated timber panel. For example, in the illustrated example, the CLT sheet 58 has three layers and the thickness of the CLT sheet is ¾". In the illustrated example, the CLT sheet 58 has an overall thickness that is less than the thickness of an individual layer of the CLT panel 50 that provides the structural properties of the floor.

In some implementations, the floor assembly 100 may include one or more acoustical treatments at a floor side of the CLT panel 50. For example, in the illustrated example, an acoustic floor treatment is provided on a floor side of the CLT panel 50. The acoustic floor treatment may be, for example, a rubber pad. The rubber pad may be between five and fifteen millimeters in thickness.

In the illustrated example, the floor assembly 100 also includes a concrete layer 62 provided over the acoustic floor treatment 60. The concrete layer may, in some implementations, have a thickness of between one and a half and three inches.

Figure 2:
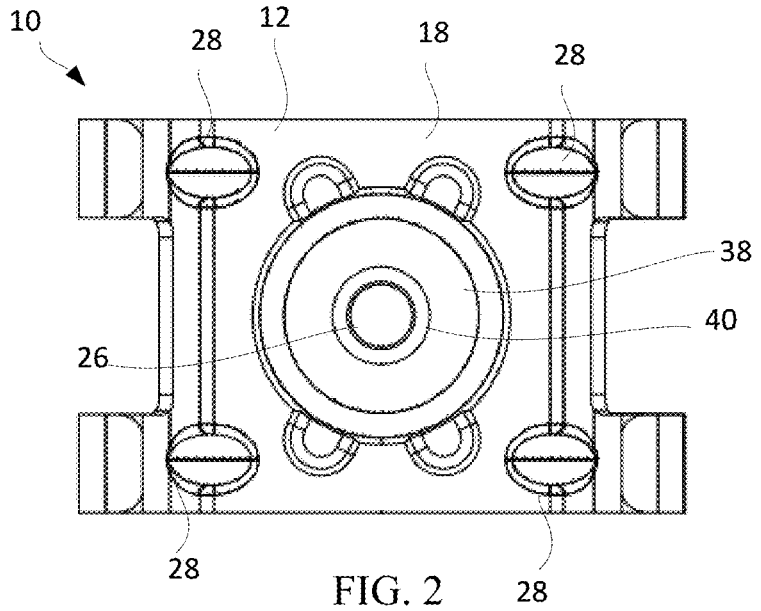
FIG. 2 is a top view of an energy control mount in accordance with an example embodiment.
Figure 3:
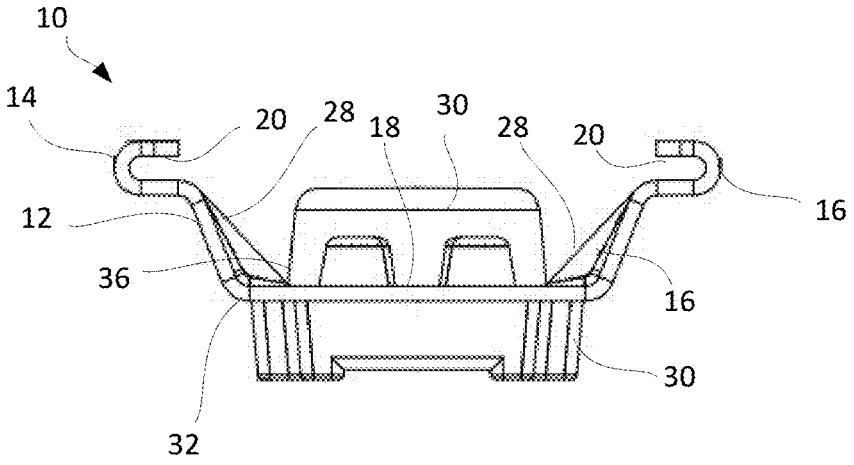
FIG. 3 is a side view of the energy control mount of FIG. 2.
Figure 4:
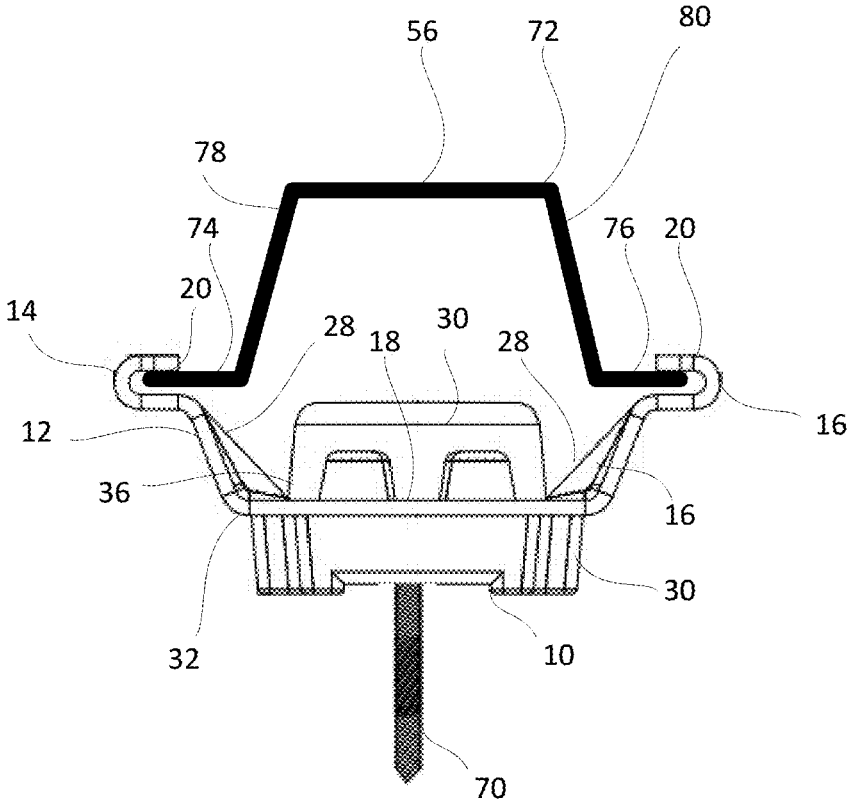
FIG. 4 is a side view of a furring channel and an energy control mount having a fastener inserted within the energy control mount.

Reference will now be made to FIGS. 2 to 4 which illustrate an example energy transmission control mount 10. The energy transmission control mount 10 includes a generally rectangular carrier 12 formed of metal such as for example steel. By way of example, the rectangular carrier 12 may be formed of galvanized steel. The ends 14, 16 of the carrier 12 are folded back over the front surface 18 of the carrier 12 to define channels 20.

A central aperture 26 is also provided through the carrier 12. Vibration dampening material 30 substantially lines the aperture 26 and extends over a portion of both the front surface 18 and the back surface 32 of the carrier 12. The vibration dampening material 30 may be, for example, polyurethane bonded recycled rubber, polyether urethane foam or other suitable energy absorbing material.

On the back surface 32, the vibration dampening material 30 may be configured to define a plurality of vertically and generally equally spaced, horizontal ribs. On the front surface 18, the vibration dampening material 30 may be configured to define a disc 36 on which a washer 38 may be disposed. The vibration dampening material 30 may substantially line the aperture of the washer 38 and form an annular flange 40 over the washer 38 to retain the washer on the disc 36.

The vibration dampening material 30 may be permanently bonded to the carrier 12.

The carrier 12 may include one or more strengthening features 28 which provide strength to the carrier 12 to resist bending of the carrier at the ends 14, 16.

A hole extends through the energy transmission control mount 10. The hole is located at a center of the energy transmission control mount. The hole extends through the vibration damping material 30 to allow a fastener to be inserted therein.

Referring now to FIG. 4, a further side view of an energy transmission control mount 10 is illustrated. In the illustrated example, a fastener 70 is shown inserted within the energy transmission control mount. The fastener 70 is a screw and it is inserted in the hole that extends through the vibration damping material 30. As discussed above with reference to FIG. 1, the fastener 70 may be used to attach the energy transmission control mount to the CLT panel 50.

FIG. 4 also shows a furring channel 56. The furring channel is a hat channel having a horizontal bottom web 72 and two legs 78, 80, which may be vertical legs or sloped legs. The legs 78, 80 have outward flanges 74, 76 which are received in the channel 20 of the energy transmission control mount 10.

As noted in the discussion of FIG. 1, the CLT sheet 58 may be attached to the furring channel 56. This may be done using a fastener, such as a screw. The fastener is selected so that it engages the furring channel 56 without directly engaging the CLT panel 50. For example, screws may be used that are short enough that they do not contact the CLT panel 50 to defeat the decoupling provided by the energy transmission control mount 10.

Figure 5:
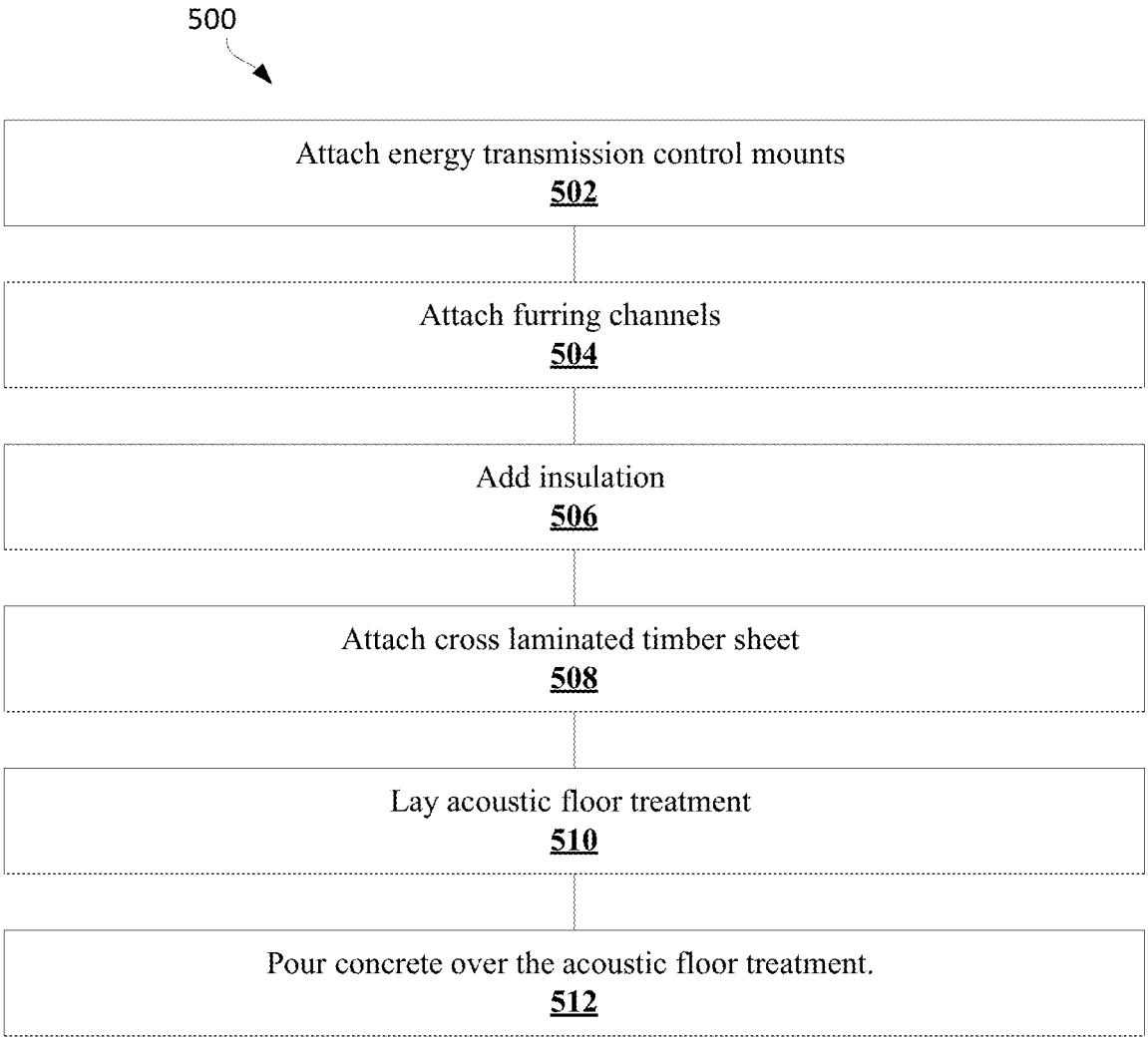
FIG. 5 is a flowchart of a method of reducing sound transmission in a building constructed using horizontal CLT panels to provide a floor of the building.

Reference will now be made to FIG. 5 which illustrates in flowchart form a method 500 of reducing sound transmission in a building constructed using horizontal cross laminated timber (CLT) panels to provide a floor of the building. The method 500 may be performed to construct a floor assembly 100 of the type illustrated in FIG. 1, for example.

The method 500 may include, at step 502, attaching a plurality of energy transmission control mounts 10 to a ceiling side of one or more of the cross-laminated timber panels. The energy transmission control mounts 10 may be attached using fasteners 70. For example, the energy transmission control mounts 10 may be screwed into the ceiling side of the CLT panel(s) 50. The energy transmission control mounts 10 may be attached in the manner described above with reference to FIG. 1 and the energy transmission control mounts 10 may be of the type described above with reference to FIGS. 2 to 4.

At step 504, furring channels 56 may be attached to the energy transmission control mounts 10. The furring channels 56 may be attached in the manner described above with reference to FIGS. 2 to 4 and the furring channels 56 may be as described above. For example, the furring channels may be hat channels that are received in channels 20 of the energy transmission control mounts 10.

The furring channels 56 may be attached to define a gap below the CLT panels and the method further includes inserting insulation into the gap. The gap may also be referred to herein as a cavity. The cavity may be or include the space between a top of the furring channels 56 and a bottom of the CLT panel 50 above such furring channels (as illustrated in FIG. 1). The gap may also be or include a gap defined by the height of the furring channels 56. For example, the gap may be or include the spacing between adjacent furring channels 56.

In at least some implementations, the method may include, at step 506, adding insulation 54 in one or more of the gaps. For example, as illustrated in FIG. 1, insulation 54 may be inserted in the gap that is defined by the height of the energy transmission control mounts 10. For example, the insulation 54 may be inserted between the CLT panel 50 and the furring channels 56. The insulation may be of the type described above with reference to FIG. 1. For example, the insulation may be R8 insulation.

The steps 504 and 506 of the method 500 may, in some instances, be reversed. For example, in some installations it may be easier to add the insulation before installing the furring channels 56. Further, in some installations, the insulation may be omitted.

Next, at a step 508, a CLT sheet 58 is attached to the furring channels. The CLT sheet is attached to form an exposed ceiling layer. The CLT sheet 58 may be of the type described above with reference to FIG. 1 and may be attached as described above with reference to FIGS. 1 to 4. For example, a fastener such as a screw may be used to make the attachment. By way of further example, the CLT sheets 58 may be three quarter inch or less in thickness. In some implementations, the CLT sheets 58 are less than one inch in thickness. The cross laminated timber sheet may have layers that are less than one third of the thickness of layers of the cross laminated timber panel. The cross laminated timber sheet may have an overall thickness that is less than the thickness of an individual layer of the cross laminated timber panel.

In some implementations, further soundproofing may be provided at a floor side of the CLT panel 50. For example, at a step 510, the method 500 may include laying an acoustic floor treatment 60 on a floor side of the CLT panel. The acoustic floor treatment 60 may as described above. For example, the acoustic floor treatment may be a rubber pad. The acoustic floor treatment 60 may be between five and fifteen millimeters in thickness.

In some implementations, at a step 512, the method 500 may include pouring concrete 62 over the acoustic floor treatment 60. The concrete 60 may be poured to a thickness of between one and a half and three inches, for example.

Figure 6:
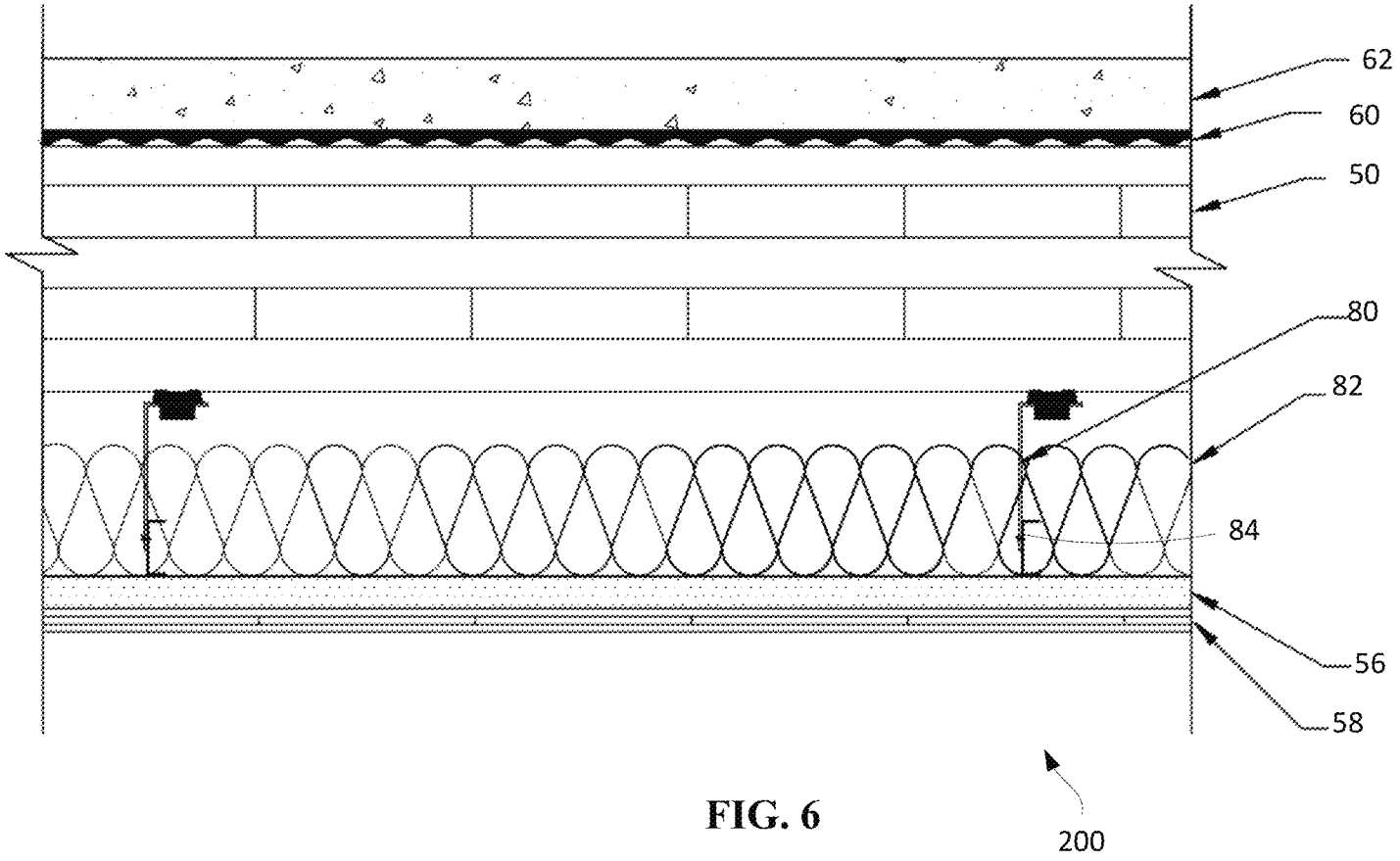
FIG. 6 is a cross section of a floor assembly of a further example embodiment.

Reference will now be made to FIG. 6 which illustrates a further example floor assembly 200. The floor assembly 200 of FIG. 6 includes many features in common with those of the floor assembly 100 of FIG. 1 and such features are identified by common reference numerals and such features may be as described above. For example, the floor assembly 200 may include a CLT panel 50. An acoustic floor treatment 60 may be laid on a floor side of the CLT panel 50 as described above with reference to FIG. 1 and concrete 62 may overlay the CLT panel. The floor assembly also includes furring channels 56 and an exposed CLT sheet 58.

The acoustic floor treatment 60, the CLT panel 50, the concrete 62, the furring channels 56 and the exposed CLT sheet 58 may be as described above with reference to FIG. 1.

The primary difference between the floor assembly 200 of FIG. 6 and that of FIG. 1 is that the floor assembly 200 of FIG. 6 has a larger gap. This larger gap may be used to accommodate more insulation. For example, in some implementations, R15 or higher insulation may be included in the gap. The larger gap may be provided using a different energy transmission control mount 80 than was used in the floor assembly 100 of FIG. 1 and/or by using a spacing feature 84 to further extend the gap.

Figure 9:
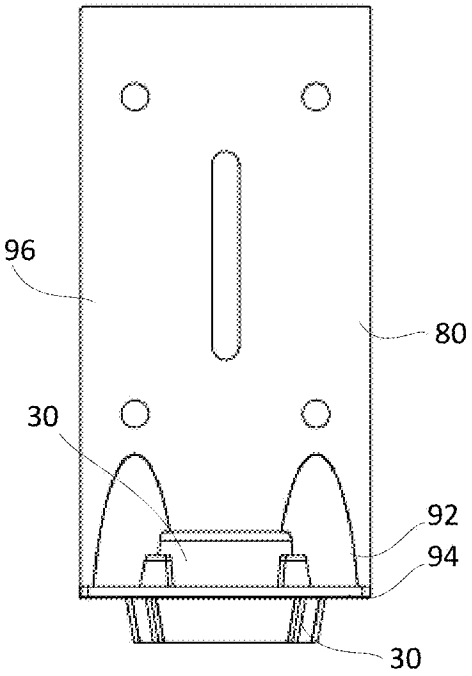
FIG. 9 is a front view of the energy control mount of FIG. 8.
Figure 8:
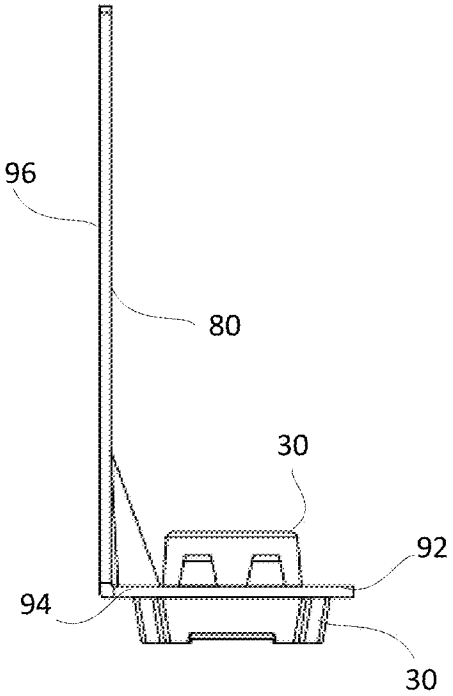
FIG. 8 is a side view of the energy control mount of FIG. 7.
Figure 7:
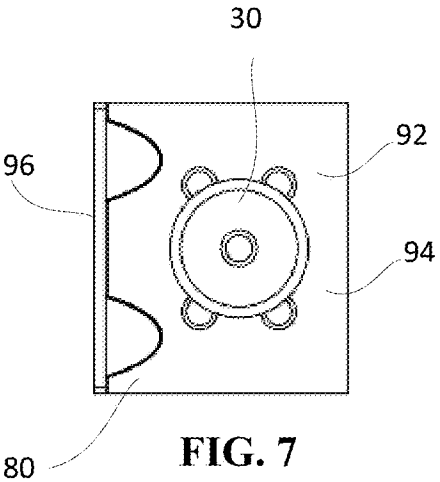
FIG. 7 is a top view of an energy control mount in accordance with a further example embodiment.

Like in the floor assembly 100 of FIG. 1, in the floor assembly 200 of FIG. 6, a plurality of energy transmission control mounts 80 are attached to the CLT panel 50. Such attachment may be done in a row-wise manner. Referring to FIGS. 7 to 9, an example energy transmission control mount 80 is illustrated. The energy transmission control mount 80 includes many features that are the same as those of the energy transmission control mount 10 of FIGS. 1 to 4 and the discussion of such features will not be repeated. Such features are depicted with common reference numerals and/or common shapes.

The energy transmission control mount 80 does not include the channels 20 and the carrier 92 is shaped differently than the carrier 12 of the energy transmission control mount 80 of FIGS. 1 to 4. In the example of FIGS. 6 to 9, the carrier 12 is L-shaped. The L-shaped carrier has a base portion or base plate 94 that attaches to the vibration damping material 30. The L-shaped carrier also has an elongate plate 96 which is generally perpendicular to the base plate 94. The elongate plate is, in at least some implementations, at least three inches long to create a gap between the CLT panels and the CLT sheets that is three inches or more.

The elongate plate 96 may include one or more holes or slots that may be used for attachment to the elongate plate 96. For example, referring again to FIG. 6, in some implementations a spacing feature 84 may be attached to the elongate plate 96 and such attachment may be made using the holes or slots.

The spacing feature 84 may be of various types. For example, in one implementation, it may be a channel, such as a C-shaped channel. The spacing feature 84 may, for example, be a cold rolled channel. The spacing feature 84 may further extend the gap to accommodate more insulation and/or to provide more vacant space between layers. The gap is, in some implementations, five inches or more. In some implementations, the gap may be approximately six inches. Insulation 82 may be inserted within the gap.

In the illustrated example, furring channels 56 are attached to an underside of the spacing feature 84 and the CLT sheet 58 is attached to the furring channels 56. The furring channels 56 may be attached to the spacing feature 84 using one or more fasteners, such as screws.

Figure 10:
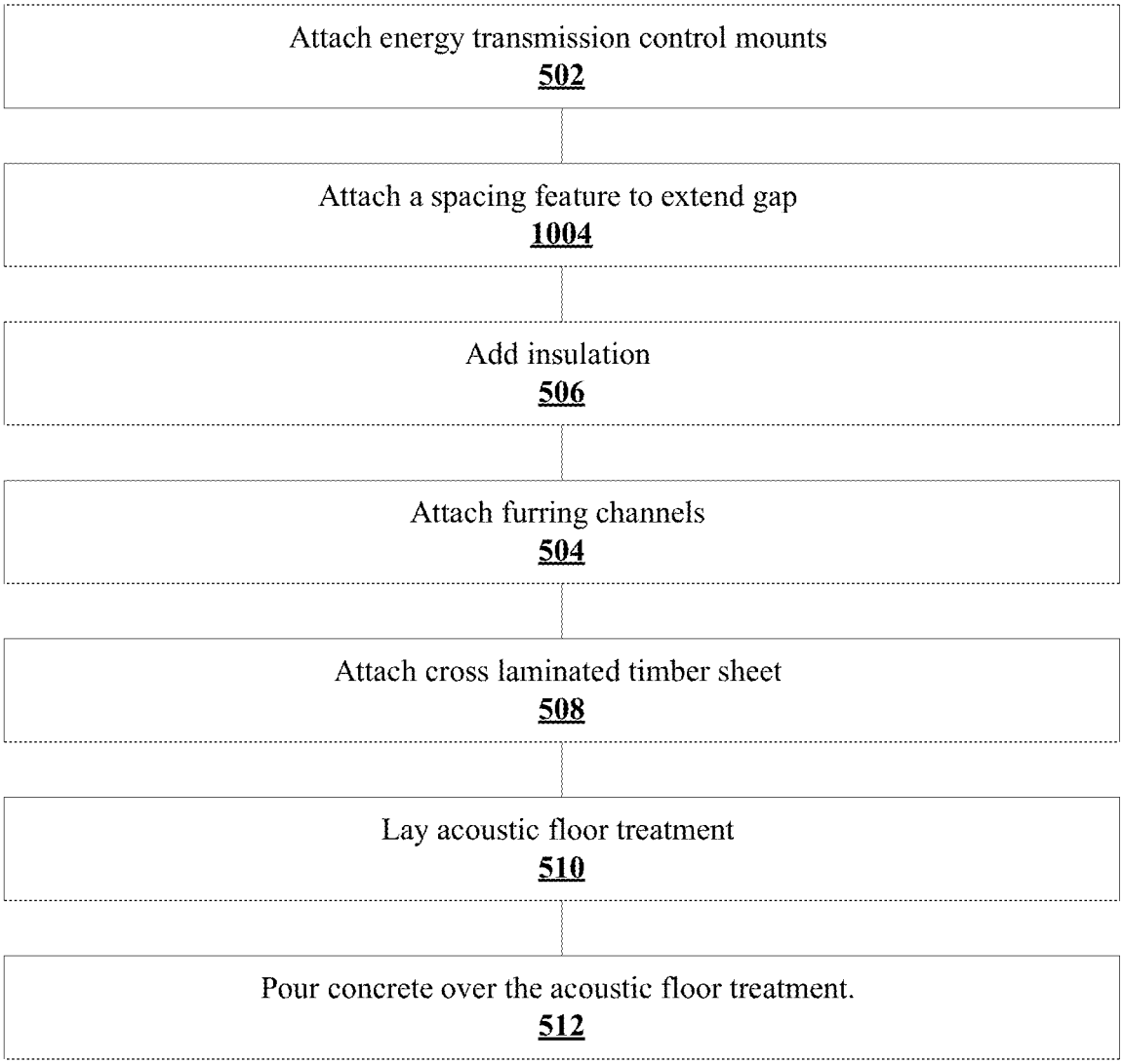
FIG. 10 is a flowchart of a method of reducing sound transmission in a building constructed using horizontal CLT panels to provide a floor of the building.

Reference will now be made to FIG. 10 which illustrates in flowchart form a method 1000 of reducing sound transmission in a building constructed using horizontal cross laminated timber (CLT) panels to provide a floor of the building. The method 1000 may be used to construct a floor assembly 200 of the type described above with reference to FIG. 6.

At step 502, energy transmission control mounts 80 may be attached to a CLT panel 50. Step 502 may be performed as described above with reference to FIG. 5 except the energy transmission control mounts 80 may be the elongated version illustrated in FIGS. 7 to 9.

At step 1004, the method 1000 may include adding a spacing feature 84 to extend a gap as described above with reference to FIG. 6. Insulation may be added at step 506 as described above with reference to the method 500 of FIG. 5 except that a greater amount of insulation may be used to take advantage of the larger gap provided by the elongate energy transmission control mounts 80 and/or the spacing feature 84.

At step 504, furring channels 56 may be added as described above with reference to the method 500 of FIG. 5 except that the attachment may be to the spacing feature 84.

At step 508, a CLT sheet 58 may be attached to the furring channels 56 as described above with reference to the method 500 of FIG. 5.

At step 510, an acoustic floor treatment 60 may be added as described above with reference to the method 500 of FIG. 5.

At step 512, concrete may be added as described above with reference to the method 500 of FIG. 5.

While the above description refers to a floor assembly, the same techniques could be used to provide a wall assembly in a building that uses CLT panels for wall construction. For example, the energy transmission control mounts 10,80 may be mounted vertical CLT panels that define a wall in order to mount a decoupled CLT sheet that may act as an exposed wall.

Further, it may be noted that the implementations described herein which provide a gap may in some installations allow for the installation of electrical wiring within such gaps. For example, high and low voltage wiring may be installed within such gaps. It may be noted that an implementation of the type described above with reference to FIGS. 6 to 10 which provides a larger gap may be desirable for such installations to provide extra room for such wiring. The gaps that are provided using the techniques described herein may also be used to, for example, run plumbing or mechanical services including radiant heat tubes, thin ducting, etc. In this way, the techniques described herein may assist in reducing sound transmission and also be useful to hide electrical, mechanical and/or plumbing features.

As noted, certain adaptations and modifications of the described embodiments can be made. Therefore, the above discussed embodiments are considered to be illustrative and not restrictive.

The invention claimed is:

1. A method of reducing sound transmission in a building constructed using horizontal cross laminated timber (CLT) panels to provide a floor of the building, the method comprising:

attaching a plurality of energy transmission control mounts to a ceiling side of one or more of the cross-laminated timber panels using fasteners;

attaching a plurality of furring channels to the energy transmission control mounts; and attaching a cross laminated timber (CLT) sheet to the plurality of furring channels to form an exposed ceiling layer that is exposed on a lowest side of the CLT sheet.

2. The method of claim 1, wherein the furring channels are hat channels received in channels of the energy transmission control mounts.

3. The method of claim 1, wherein the cross laminated timber sheet is three quarter inch or less in thickness.

4. The method of claim 1, wherein the cross laminated timber sheet is less than one inch in thickness.

5. The method of claim 1, wherein the furring channels are attached to define a gap below the CLT panels and the method further includes inserting insulation into the gap.

6. The method of claim 5, wherein the insulation is R8 insulation.

7. The method of claim 1, wherein each energy transmission control mount includes an elongate plate at least three inches long to create a gap between the CLT panels and the CLT sheets that is three inches or more.

8. The method of claim 7, further comprising attaching a spacing feature to each energy transmission control mount to further extend the gap.

9. The method of claim 7, wherein the gap is five inches or more.

10. The method of claim 7, wherein the gap is approximately six inches.

11. The method of claim 7, further comprising inserting insulation within the gap.

12. The method of claim 1, further comprising:

laying an acoustic floor treatment on a floor side of the CLT panel.

13. The method of claim 12, further comprising:

pouring concrete over the acoustic floor treatment.

14. The method of claim 13, wherein the concrete is poured to a thickness of between one and a half and three inches.

15. The method of claim 12 wherein the acoustic floor treatment is a rubber pad between five and fifteen millimeters in thickness.

16. The method of claim 1, wherein each cross laminated timber sheet has layers that are less than one third of the thickness of layers of each cross laminated timber panel.

17. The method of claim 1, wherein each cross laminated timber sheet has an overall thickness that is less than the thickness of an individual layer of each cross laminated timber panel.

18. A floor assembly in a building, the floor assembly comprising:

a cross laminated timber (CLT) panel;

a plurality of energy transmission control mounts attached to a ceiling side of the cross laminated timber panel using fasteners;

a plurality of furring channels attached to the energy transmission control mounts; and a cross laminated timber (CLT) sheet attached to the plurality of furring channels to form an exposed ceiling layer that is exposed on a lowest side of the CLT sheet.

19. The floor assembly of claim 18, wherein the furring channels are hat channels received in channels of the energy transmission control mounts.

20. The floor assembly of claim 18, wherein the cross laminated timber sheet is three quarter inch or less in thickness.

21. The floor assembly of claim 18, wherein the cross laminated timber sheet is less than one inch in thickness.

22. The floor assembly of claim 18, wherein the furring channels are attached to define a gap below the CLT panels and wherein the floor assembly further includes insulation in the gap.

23. The floor assembly of claim 22, wherein the insulation is R8 insulation.

24. The floor assembly of claim 18, wherein each energy transmission control mount includes an elongate plate at least three inches long to create a gap between the CLT panels and the CLT sheets that is three inches or more.

25. The floor assembly of claim 24, further comprising a spacing feature attached to each energy transmission control mount to further extend the gap.

26. The floor assembly of claim 24, wherein the gap is five inches or more.

27. The floor assembly of claim 24, wherein the gap is approximately six inches.

28. The floor assembly of claim 24, further comprising insulation within the gap.

29. The floor assembly of claim 18, further comprising:

an acoustic floor treatment provided on a floor side of the CLT panel.

30. The floor assembly of claim 29, further comprising:

a concrete layer provided over the acoustic floor treatment.

31. The floor assembly of claim 30, wherein the concrete layer has a thickness of between one and a half and three inches.

32. The floor assembly of claim 30 wherein the acoustic floor treatment is a rubber pad between five and fifteen millimeters in thickness.

33. The floor assembly of claim 18, wherein the cross laminated timber sheet has layers that are less than one third of the thickness of layers of the cross laminated timber panel.

34. The floor assembly of claim 18, wherein the cross laminated timber sheet has an overall thickness that is less than the thickness of an individual layer of the cross laminated timber panel.

* * * * *